United States Patent [19]

Beauvais

[11] 4,053,049

[45] Oct. 11, 1977

[54] PACKAGING OF SEMICYLINDRICAL SLEEVE BEARINGS

[75] Inventor: Albert L. Beauvais, Birmingham, Mich.

[73] Assignee: Federal-Mogul Corporation, Detroit, Mich.

[21] Appl. No.: 659,383

[22] Filed: Feb. 19, 1976

[51] Int. Cl.[2] ..... B65D 85/30

[52] U.S. Cl. ..... 206/318; 206/460; 206/499; 206/813

[58] Field of Search ..... 206/318, 344, 345, 448, 206/460, 499, 521, 813

[56] References Cited

U.S. PATENT DOCUMENTS

| | | | |
|---|---|---|---|
| 1,840,638 | 1/1932 | Scribner | 206/318 X |
| 1,907,015 | 5/1933 | Swart | 206/318 X |
| 1,982,932 | 12/1934 | Scribner | 206/318 X |
| 2,379,934 | 7/1945 | Seiferth | 206/813 X |
| 2,747,768 | 5/1956 | Raines | 206/499 X |
| 3,221,874 | 12/1965 | Pitner | 206/318 |
| 3,307,685 | 3/1967 | White | 206/318 |
| 3,337,037 | 8/1967 | Thill et al. | 206/318 |
| 3,342,321 | 9/1967 | Haffey | 206/318 |
| 3,459,297 | 8/1969 | Templeton et al. | 206/460 X |
| 3,472,366 | 10/1969 | Ackerman | 206/344 |

*Primary Examiner*—Stephen Marcus
*Attorney, Agent, or Firm*—Robert F. Hess

[57] ABSTRACT

A system for packaging a plurality of nested objects wherein adhesive strips are applied to either side of the tightly nested objects to form a rigid unitary package in which the tightly nested objects will withstand compressive stresses and the adhesive strips will withstand tensile stresses which may be applied to the structure during handling or shipping to the customer.

6 Claims, 3 Drawing Figures

PACKAGING OF SEMICYLINDRICAL SLEEVE BEARINGS

BACKGROUND OF THE INVENTION

The art of packaging deals with many problems depending on what is to be packaged and what is to be accomplished by the packaging. Usually the dominant factor in creating a package is to protect objects from damage during transportation. Other packages provide protection to handlers as would be the case in shipping razor blades, explosives, acids, and the like. In addition, packages may provide economy of shipping space, exclusion of dirt, ease of handling, attractive displays, identification of enclosed materials, shipping instructions, et catera, in many combinations depending on the requirements of the situation.

The packaging of modern sleeve bearings has very special requirements. These bearings in general comprise a cylindrical sleeve that is made up of two mating semicylindrical half sleeves placed end to end so that they accurately and closely encompass a round shaft within a bore so that the shaft is supported uniformly but is allowed to rotate freely on a thin intervening film of oil.

These bearing halves are made from shaped bi-metal sheets. The inside surface, which is next to the rotating shaft, is a comparatively soft bearing material such as babbitt metal or aluminum alloy, while the outer surface that mates with the bore is steel.

When parts such as these are transported it is absolutely necessary that the sharp steel end of one part does not mar or displace the smooth finish of the comparatively soft inner surface of the mating part.

This will occur if there is any movement such as oscillation, between the hard surface and the soft surface when in contact under pressure. Any such surface displacement is likely to destroy the intervening oil film referred to earlier and result in metal to metal contact between bearing and shaft. This in turn will cause premature failure in a bearing installation.

Consequently, in the past, semicylindrical sleeve bearings have been shipped in pairs in individual boxes with a separation of paper strip or the like positioned between bearing shells to prevent marring. Examples of such an arrangement are shown as in U.S. Pat. No. 3,307,685 to White, assigned to the assignor of the subject invention. U.S. Pat. No. 3,337,037 to Thill et al, also assigned to the assignor of the subject invention shows a similar invention wherein there is taught the use of a tab integral with the surrounding box as the separating member. In either case, however, a thin partition of some relatively soft material, such as paperboard, separates the enclosed parts from each other so that the sharp steel end of one half-bearing, or bearing shell, does not come in contact with the critical inner surface of the other half-bearing. If this were not done, one part could destroy the soft surface of the other part during shipment in the loosely confining package. The result would be a product that would be useless when it arrived in the hands of the consumer.

Such prior art packaging arrangements as above referred to are effective but costly in waste packaging material, waste shipping space, and inconvenience. It is these problems to which the present invention is addressed.

SUMMARY OF THE INVENTION

The present packaging invention places the semicylindrical half bearings in a uniform row, convex side to concave side, with positive contact between parts and with no distortion. The parts are maintained in this position by the application of taut non-stretchable pressure sensitive tape to both sides of the row (top and bottom if the parts are lying on their sides). This arrangement uses the inherent rigidity of the parts being packaged as the compressive member of a cantilever beam. The tensile member of the cantilever beam is supplied by the strips of non-stretching adhesive tape or the like on each side of the tightly imbricated plurality of parts. When a bending moment is applied to such a configuration, the tendency is for one side to become compressed while the opposite side tries to stretch. Due to the cantilever beam construction, however, relative motion between parts is reduced to such a degree that is virtually non-existant. Actual packages made up of parts packaged thusly and shipped through the mail have shown no signs of relative motion, itching, denting, abrading, or other surface distortion.

DESCRIPTION OF THE PREFERRED EMBODIMENT

Figure 1:
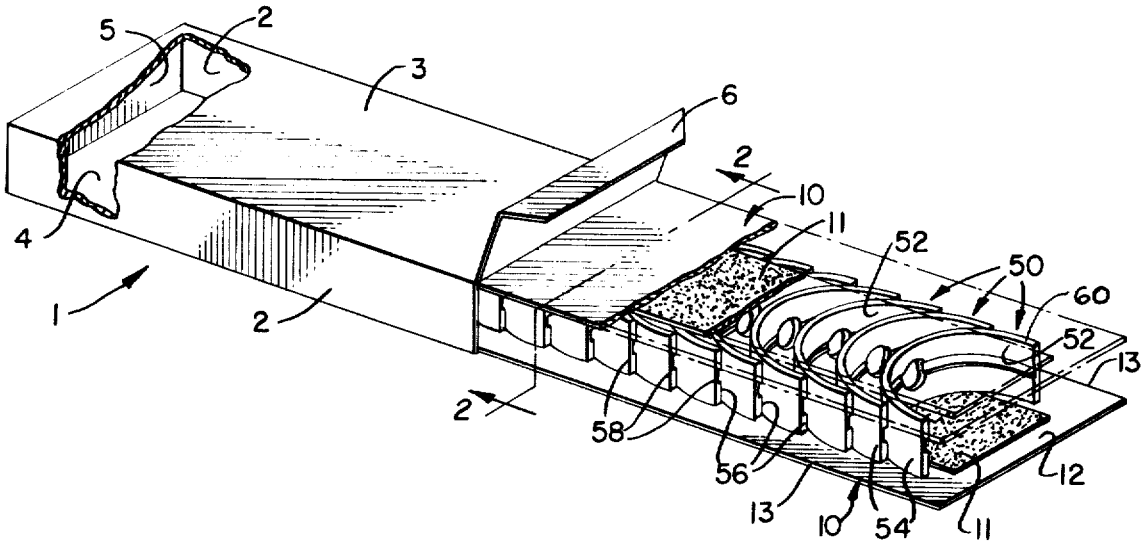
FIG. 1 is a view in perspective in partial cross-section of a row of nested engine bearings partially inserted in a box with the upper adhesive paperboard backing broken away to show nesting details of the bearings which embody the principles of the invention.
Figure 2:
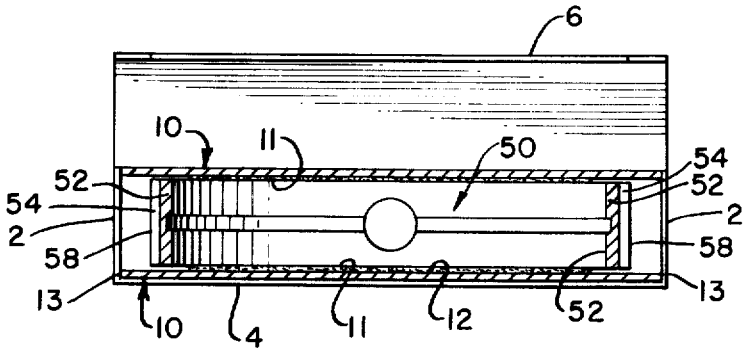
FIG. 2 is a cross-sectional view of FIG. 1 taken at 2-2.
Figure 3:
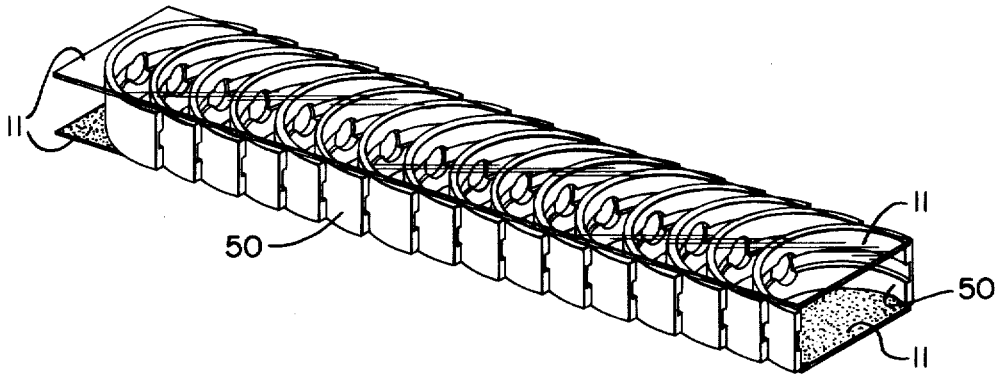
FIG. 3 is a view in perspective of another embodiment of the invention.

As shown in FIG. 1 the packaging arrangement of my invention consists of three items, namely an enclosing box 1, and two identical backing strips 10. The bearing shells themselves add the requisite integrity and strength to the package and perhaps should be considered collectively as the fourth item making up the package.

The box is fully enclosed and has two opposed sides, 2, a front cover, 3, a back cover, 4, a bottom, 5, and a top consisting of a foldable flap 6.

Each backing strip 10 is of rigid material. At least it should be rigid enough to reasonably withstand the loading from side 2 to side 2 to which the box 1 and it at its correspondingly lateral edges 13, 13 may be normally subjected during handling and shipping. Paperboard is my preferred material. It is reasonably rigid and is also relatively inexpensive. A permanently tacky adhesive layer 11 is secured to the facing side 12 of each strip. For convenience I prefer the use of double-backed, non-stretchable tape. Alternately, the adhesive could be brushed on or applied in any number of different ways.

The adhesive used in any case is of the pressure sensitive type so that adherence is obtained by simply pressing the tape against the surface to which it is to adhere. In the packaging of bearings, the adhesive must have two other characteristics; namely, it must not contain components that will corrode or otherwise be injurious to the bearings 50 and it must have greater affinity for the tape 11 or the paperboard 10 than for the bearings 50 so that the bearings 50 can be removed from the adhesive with no residue being left on the bearing 50. In the preferred embodiment, therefore, the most effective adhesive found so far has had a firm, high temperature, crude rubber base. In other applications, such adhesive bases as silicones and acrylics might be preferable.

To assemble the package the generally semicylindrical bearings 50 shown in FIG. 1 are nested together in a row so that the soft inner surface 52 of one bearing shell is in a position to lightly contact the smooth, hard, outer steel surface 54 of an adjoining bearing shell 50 along a line 56. The hard, sharp, steel edges 58 of each bearing shell 50 is exposed to the air and does not impinge on any other bearing shell 50. The adhesive layer 11 holds the bearing shells in their relative position at their top and bottom axial edges 60. The adhesive sides of the tapes 11 which are not in contact with the bearing shells 50 in the case of double backed tape are stuck to the paperboard backing strips 10 to give added tensile strength to the cantilever beam thus formed. In this configuration, the bearing shells 50 carry the compressive stresses on the beam structure while the tapes 11 and the backing strips 10 carry the tensile stesses. Any bending movement, therefore, which is imposed on the cantilever beam, tries to stretch one side of the beam while the opposite side is compressed. Due to the structural rigidity of the arrangement, however, relative movement between the nested bearings 10 is virtually nonexistent and no fretting or chafing occurs between parts.

The paperboard backing strip 10 serves another function in that it centers the bearing shells 50 within the enclosing box 1. For example, it will be noted from FIG. 1 that edges 58 are inboard of the lateral edges 13 of the backing 10. This has the advantage of eliminating any load in the bearings due to forces applied to the box 1 on the sides 2 thereof.

As an alternate embodiment, singles backed nonstretching tapes with no paperboard backing can be used where no rough handling is expected.

Furthermore, a single box containing a plurality of layers of rows of nested parts forming a series of individual cantilever beams within the box is yet another alternative embodiment of my invention.

Likewise, rather than using two separate backing strips, one strip folded over at the end of the row of nested bearing shells would work perfectly well.

To those skilled in the art to which this invention rleates, many other changes in construction and widely differing embodiments and applications of the invention will suggest themselves without departing from the spirit and scope of the invention. The disclosures and description herein are purely illustrative and are not intended in any sense to be limiting.

I claim:

1. A packaging arrangement comprising a plurality of uniformly shaped, partially cylindrical parts, each of said parts having a concave front wall and a convex back wall, and being arranged in a planar row in nested relationship such that the leading end portion of the front wall of each said part lightly contacts the back wall of an adjacent leading one of said parts without distorting either of said parts in contact with one another, each of said parts being of uniform height measuring from the top of said walls to the bottom of said walls throughout and being equal in height to each of said other parts, said plurality of parts as nested together forming the compressive member of a cantilever beam defined by the entire said row of parts, non-stretchable adhesive means disposed on and adhering to the top of said walls and to the bottom of said walls of said parts and encompassing each of said end portions forming the area of contact between said parts and forming along the top and bottom of said walls an upper and a lower tensile member, respectively, of the aforementioned cantilever beam and thereby constituting a unitary package whereby each of said nested parts is absolutely without freedom of movement relative to each other when subjected to normal shipping handling.

2. A packaging arrangement as in claim 1 in which said nonstretchable adhesive means consists of a single-backed pressure-sensitive tape.

3. A packaging arrangement as in claim 1 wherein said nonstretchable means comprises two separate adhesive strips with one of said adhesive strips being disposed solely on the top of said walls and the other of said adhesive strips being disposed solely on the bottom of said walls, each of said adhesive strips consisting of a rigid, relatively thin, backing strip and a layer of pressure-sensitive adhesive means applied directly to one side of said backing strip over said area of contact formed by said end portions of each of said parts, said two separate adhesive strips being disposed oppositely from one another in parallel relation and defining together with said parts enclosed therebetween a rectangular shaped box structure.

4. A packaging arrangement as in claim 3 wherein, said backing strips are of paperboard material and extend symmetrically beyond the edges of said nested parts.

5. A packaging arrangement as in claim 4 further including a box to enclose said rectangular shaped box structure package, the internal length and width of said box being the same as the length and width of said backing strip and the height of said rectangular shaped box structure being equal to the inside height of said box.

6. A packaging arrangement comprising a plurality of semicylindrical sleeve bearings tightly and symmetrically nested together in a planar row without distortion forming the compressive member of a cantilever beam and a nonstretchable adhesive means disposed on and adhering to both axial ends of each nested semicylindrical sleeve bearing forming the lateral and longitudinal tensile members of said cantilver beam, wherein said adhesive means comprising two paperboard strips each one of which is coated on one side with a pressure sensitive adhesive and disposed on and adhering to the opposite said axial ends of said bearings in said planar row, said paperboard strips being sized to symmetrically overlap the boundries of said planar row forming a unitary package of said cantilever beam, a box to enclose said unitary package the internal dimensions of said box being the same as the external dimensions of said unitary package, each of said sleeve bearings being of bi-metal strip wherein one layer of said bi-metal strip is a relatively soft bearing metal and the other layer of said bi-metal strip is relatively hard metal and the surface of the relatively soft bearing metal of one of said bearings is in nested contact with the surface of the relatively hard metal layer of an adjacent and contiguous other of said bearings in said planar now.

* * * * *